US012352271B2

(12) United States Patent
Lee et al.

(10) Patent No.: US 12,352,271 B2
(45) Date of Patent: Jul. 8, 2025

(54) VERTICAL MULTI-STAGE SUBMERSIBLE PUMP

(71) Applicant: DAIJIN PRECISION CO., LTD., Siheung-si (KR)

(72) Inventors: Jubeak Lee, Incheon (KR); Daehoon Kang, Siheung-si (KR)

(73) Assignee: DAIJIN PRECISION CO., LTD., Siheung-si (KR)

( * ) Notice: Subject to any disclaimer, the term of this patent is extended or adjusted under 35 U.S.C. 154(b) by 93 days.

(21) Appl. No.: 18/487,113

(22) Filed: Oct. 15, 2023

(65) Prior Publication Data

US 2025/0122880 A1 Apr. 17, 2025

(30) Foreign Application Priority Data

Aug. 17, 2022 (KR) ..... 10-2022-0102576

(51) Int. Cl.
*F04D 13/08* (2006.01)
*F04D 29/40* (2006.01)
*F04D 29/70* (2006.01)

(52) U.S. Cl.
CPC ..... *F04D 13/08* (2013.01); *F04D 29/406* (2013.01); *F04D 29/708* (2013.01)

(58) Field of Classification Search
CPC ..... F04D 13/08; F04D 29/406; F04D 29/708
See application file for complete search history.

(56) References Cited

U.S. PATENT DOCUMENTS 5,378,121 A * 1/1995 Hackett ..... F04D 7/045 417/423.12
5,494,403 A * 2/1996 Kobayashi ..... F04D 29/2266 415/102
5,888,053 A * 3/1999 Kobayashi ..... F04D 29/445 417/244
11,031,149 B1 * 6/2021 Innes ..... F04D 29/708
12,110,909 B2 * 10/2024 Watanabe ..... F04D 29/708
(Continued)

FOREIGN PATENT DOCUMENTS

CN 108799135 A * 11/2018
CN 110410331 A * 11/2019
(Continued)

OTHER PUBLICATIONS

English translation of JP2020070765 (Year: 2020).*
English translation of KR 101811866 (Year: 2017).*

*Primary Examiner* — Dominick L Plakkoottam
(74) *Attorney, Agent, or Firm* — You & IP, LLC

(57) ABSTRACT

A vertical multi-stage submersible pump include a motor part including a stator and a rotor installed in a motor casing, the motor part having a rotary shaft connected to the rotor, configured to rotate, and protruding upward from the motor casing, a water chamber casing assembled to an upper portion of the motor casing and including an oil seal and a mechanical seal configured to define a sealing structure around the rotary shaft, a suction casing assembled to an upper portion of the water chamber casing and having a suction port formed in a circumference of the suction casing so that a fluid is introduced into the suction port, the suction casing having a discharge port formed in a central portion of an upper surface of the suction casing, and a pump part.

4 Claims, 6 Drawing Sheets

(56) References Cited

U.S. PATENT DOCUMENTS

| | | | | |
|---|---|---|---|---|
| 2015/0192130 | A1* | 7/2015 | Yazykov | F04D 13/10 417/423.3 |
| 2021/0332821 | A1* | 10/2021 | Zhang | F04D 29/026 |
| 2022/0220980 | A1* | 7/2022 | Tischler | F04D 29/0416 |

FOREIGN PATENT DOCUMENTS

| | | | | | |
|---|---|---|---|---|---|
| JP | 2000-045981 | A | | 2/2000 | |
| JP | 2001-165086 | A | | 6/2001 | |
| JP | 3474354 | B2 | * | 12/2003 | |
| JP | 2017096349 | A | * | 6/2017 | F04D 13/021 |
| JP | 2020070764 | A | * | 5/2020 | |
| JP | 2020070765 | A | * | 5/2020 | |
| JP | 2022080759 | A | * | 5/2022 | |
| KR | 10-2008-0057203 | A | | 6/2008 | |
| KR | 101019856 | B1 | * | 3/2011 | |
| KR | 10-1062207 | B1 | | 9/2011 | |
| KR | 10-2013-0057017 | A | | 5/2013 | |
| KR | 102078203 | B1 | * | 2/2020 | |
| KR | 102459346 | B1 | * | 10/2022 | |

* cited by examiner

VERTICAL MULTI-STAGE SUBMERSIBLE PUMP

BACKGROUND

Field

The present disclosure relates to a vertical multi-stage submersible pump, and more particularly, to a vertical multi-stage submersible pump including a pump part and a motor part, in which a pump part is positioned above a motor part, a suction part is provided between the pump part and the motor part, such that the suction part is not clogged by foreign substances or sediment on a bottom of a water tub, and a high-lift pump is easily implemented.

Description of the Related Art

FIG. 1 is a structural view of a vertical multi-stage submersible pump in the related art.

In general, the vertical multi-stage submersible pump used in the related art is configured such that a motor part 20, which includes an electric motor, is installed above a pump part 10 in which a plurality of impellers 11 is stacked and disposed therein. A rotary shaft 21 and the impellers 11 are rotated by an operation of the motor part 20, and a fluid is introduced through a suction port 12 provided at a lower end of the pump part 10, raised sequentially through the plurality of impellers, and then discharged.

The vertical multi-stage submersible pump is advantageous in that a high-lift pump is easily implemented because the fluid is discharged while passing sequentially through the plurality of impellers.

However, in the case of the vertical multi-stage submersible pump in the related art, the suction port is disposed adjacent to a bottom of a water tub, and foreign substances or sediment on the bottom of the water tub is easily introduced into the suction port, which causes a problem in that the suction port is often clogged.

In addition, a mechanical seal 30, which is installed between the rotary shaft 21 and a casing in order to prevent a leak of the fluid, is exposed to a discharged fluid and directly receives high pressure of the discharged fluid during a process of pumping the fluid. For this reason, there is a problem in that the mechanical seal 30 is highly likely to be damaged and leak the fluid.

In addition, because a discharge flow path needs to bypass the motor part, which is provided above the pump part, in order to discharge water, which flows by the rotations of the impellers, to a location above the pump, the discharge flow path inevitably has a bent structure, which causes a problem in that a flow loss occurs, and efficiency of the pump deteriorates.

DOCUMENT OF RELATED ART

Patent Document (Patent Document 1) Korean Patent No. 10-1062207 (published on Sep. 5, 2011)

SUMMARY

An object to be achieved by the present disclosure is to provide a vertical multi-stage submersible pump including a pump part and a motor part, in which the motor part is positioned vertically below the pump part, and a suction port is provided between the motor part and the pump part.

Another object to be achieved by the present disclosure is to provide a vertical multi-stage submersible pump configured to adjust sizes of filtering holes of a strainer installed in a suction port of a pump in order to prevent foreign substances from being introduced through the pump.

Still another object to be achieved by the present disclosure is to provide a vertical multi-stage submersible pump, in which a mechanical seal is positioned at a lower end of a pump part, thereby reducing damage to the mechanical seal caused by discharge pressure of a fluid.

Yet another object to be achieved by the present disclosure is to provide a vertical multi-stage submersible pump that improves efficiency in suctioning a fluid through a suction port.

According to an aspect of the present disclosure, a vertical multi-stage submersible pump includes: a motor part including a stator and a rotor installed in a motor casing, the motor part having a rotary shaft connected to the rotor, configured to rotate, and protruding upward from the motor casing; a water chamber casing assembled to an upper portion of the motor casing and including an oil seal and a mechanical seal configured to define a sealing structure around the rotary shaft; a suction casing assembled to an upper portion of the water chamber casing and having a suction port formed in a circumference of the suction casing so that a fluid is introduced into the suction port, the suction casing having a discharge port formed in a central portion of an upper surface of the suction casing; and a pump part configured such that a plurality of impellers is spaced apart from one another in a vertical direction in a pump casing assembled to an upper portion of the suction casing, having an inlet port formed in a central portion of a bottom surface of the pump casing and connected to the discharge port of the suction casing, and having a discharge port formed in an upper surface of the pump casing, and the plurality of impellers is connected to the rotary shaft and pumps the fluid in a stepwise manner while rotating together with the rotary shaft.

Meanwhile, in the vertical multi-stage submersible pump, an upper end of the water chamber casing may have a conical structure and define a conical suction flow path having a cross-section inclined upward toward the rotary shaft collectively with the suction casing, and a plurality of guide vanes may be positioned in the suction flow path and provided in the suction casing or the water chamber casing to prevent the occurrence of vortices of the introduced fluid.

Meanwhile, the vertical multi-stage submersible may further include: a strainer installed in the suction casing to prevent foreign substances from being introduced through the suction port, in which the strainer includes: an inner strainer including a first upper plate provided in the form of a circular board, and a first side plate having a cylindrical structure extending along a circumference of the first upper plate and having a plurality of first filtering holes formed to be distributed, the first upper plate being fixedly installed on the suction casing; and an outer strainer including a second upper plate provided in the form of a circular board having a larger diameter than the first upper plate, and a second side plate having a cylindrical structure extending along a circumference of the second upper plate and having a plurality of second filtering holes formed to be distributed, the outer strainer being configured to rotate about the inner strainer in a state in which the outer strainer is disposed outside the inner strainer and coupled to the inner strainer such that sizes of the filtering holes are changed by adjusting areas in which the first filtering holes and the second filtering holes overlap one another.

Meanwhile, in the vertical multi-stage submersible pump, a guide groove may be recessed in an upper surface of the first upper plate by a predetermined depth from the upper surface of the first upper plate and extend in a circumferential direction of the first upper plate, and a guide protrusion may be formed on a bottom surface of the second upper plate and configured to move along the guide groove in a state in which the guide protrusion is introduced into the guide groove.

Meanwhile, in the vertical multi-stage submersible pump, a cable may extend to the ground from the motor part to transmit electricity and a signal for operating the motor part, and a plurality of cable fasteners for fixing the cable may be installed on at least one of the motor casing and the pump casing so that the cable is positioned at a position spaced apart from the suction port of the suction casing.

According to the present disclosure characterized as described above, when the fluid is pumped by the rotations of the impellers, the fluid is introduced through the suction port positioned above the motor part, and the introduced fluid flows upward, passes through the pump part, and then is discharged. Therefore, it is possible to remarkably reduce damage to the mechanical seal caused by pressure of the discharged fluid and reduce damage to the motor part caused by a leak of the fluid into the motor part.

In addition, the discharge flow path need not be bent to bypass the motor part when the discharge flow path through which the pumped fluid flows is configured. Therefore, it is possible to reduce a flow loss of the discharged fluid and easily implement the high-lift pump.

In addition, the conical suction flow path, which has an upward inclined cross-section, and the guide vanes, which are provided in the suction flow path, may allow the fluid, which is introduced through the suction flow path, to be introduced while maintaining a stable flow without generating vortices or turbulent flows, thereby improving efficiency in suctioning the fluid.

In addition, the strainer having the dual structure including the inner strainer and the outer strainer may adjust the passage area of the filtering holes by rotating the outer strainer. Therefore, the strainer need not be replaced even though the pumping fluids are changed (e.g., fresh water→wastewater). Therefore, it is possible to reduce maintenance costs.

In addition, it is possible to prevent the cable, which extends to the ground from the motor part positioned below the pump part, from being positioned around the suction port and degrading efficiency in suctioning the fluid.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Hereinafter, exemplary embodiments of the present disclosure will be described in detail with reference to the accompanying drawings. In the description of the present disclosure, the specific descriptions of related well-known functions or configurations will be omitted when it is determined that the specific descriptions may unnecessarily obscure the subject matter of the present disclosure.

Figure 1:
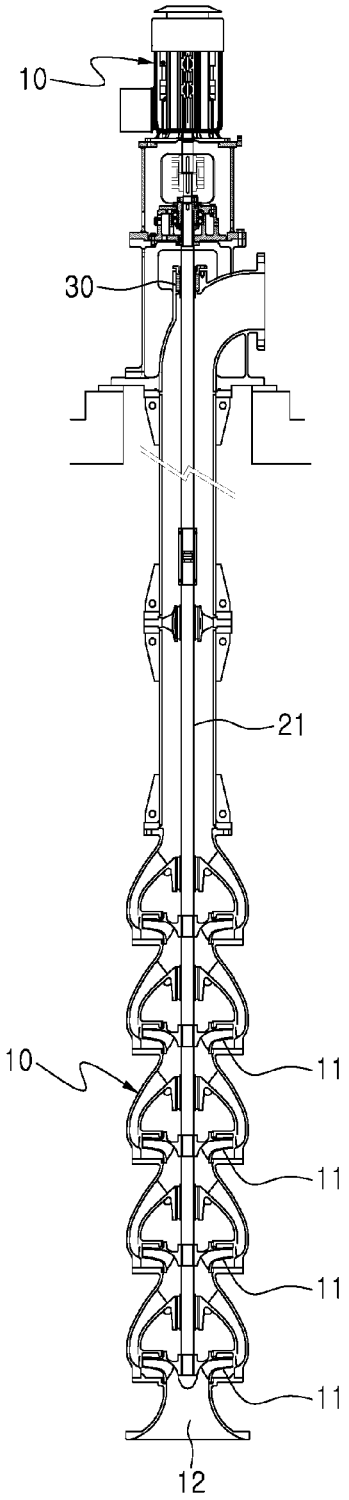
FIG. 1 is a structural view of a vertical multi-stage submersible pump in the related art.
Figure 2:
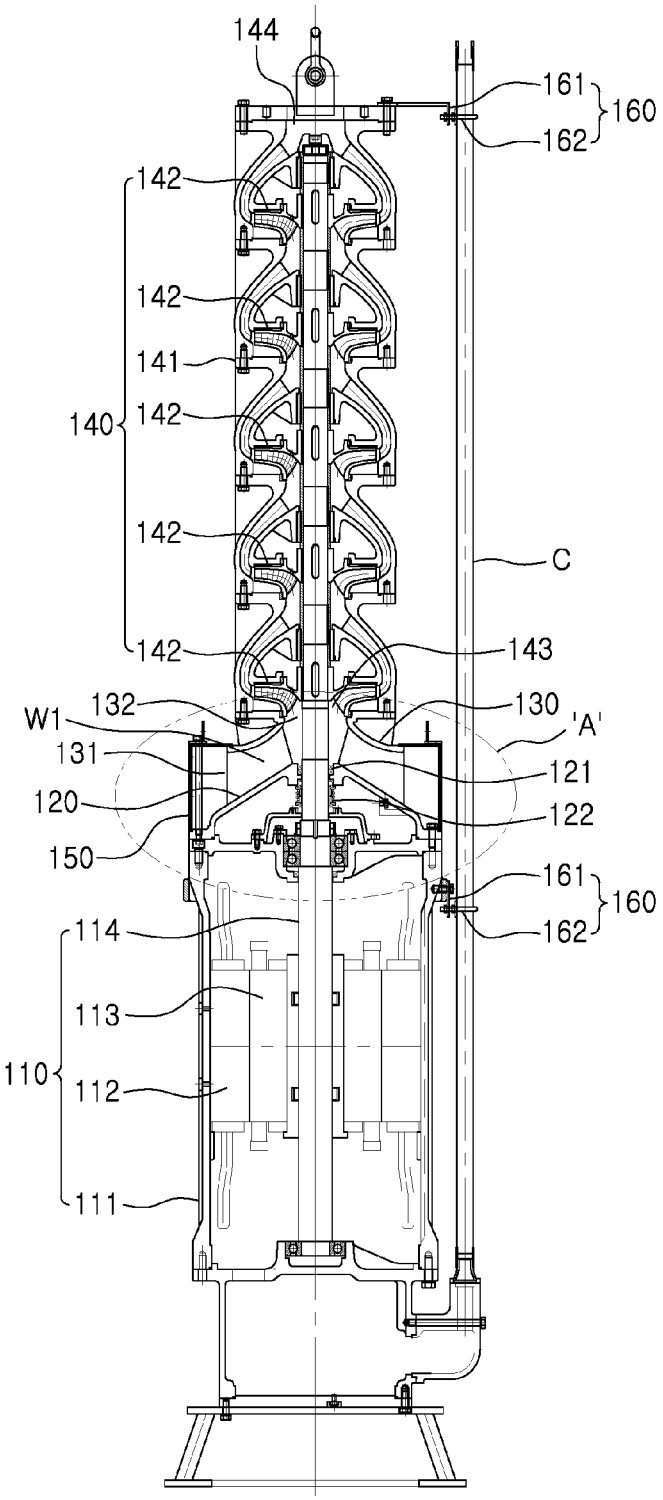
FIG. 2 is a view illustrating an internal structure of a vertical multi-stage submersible pump according to an exemplary embodiment of the present disclosure.
Figure 3:
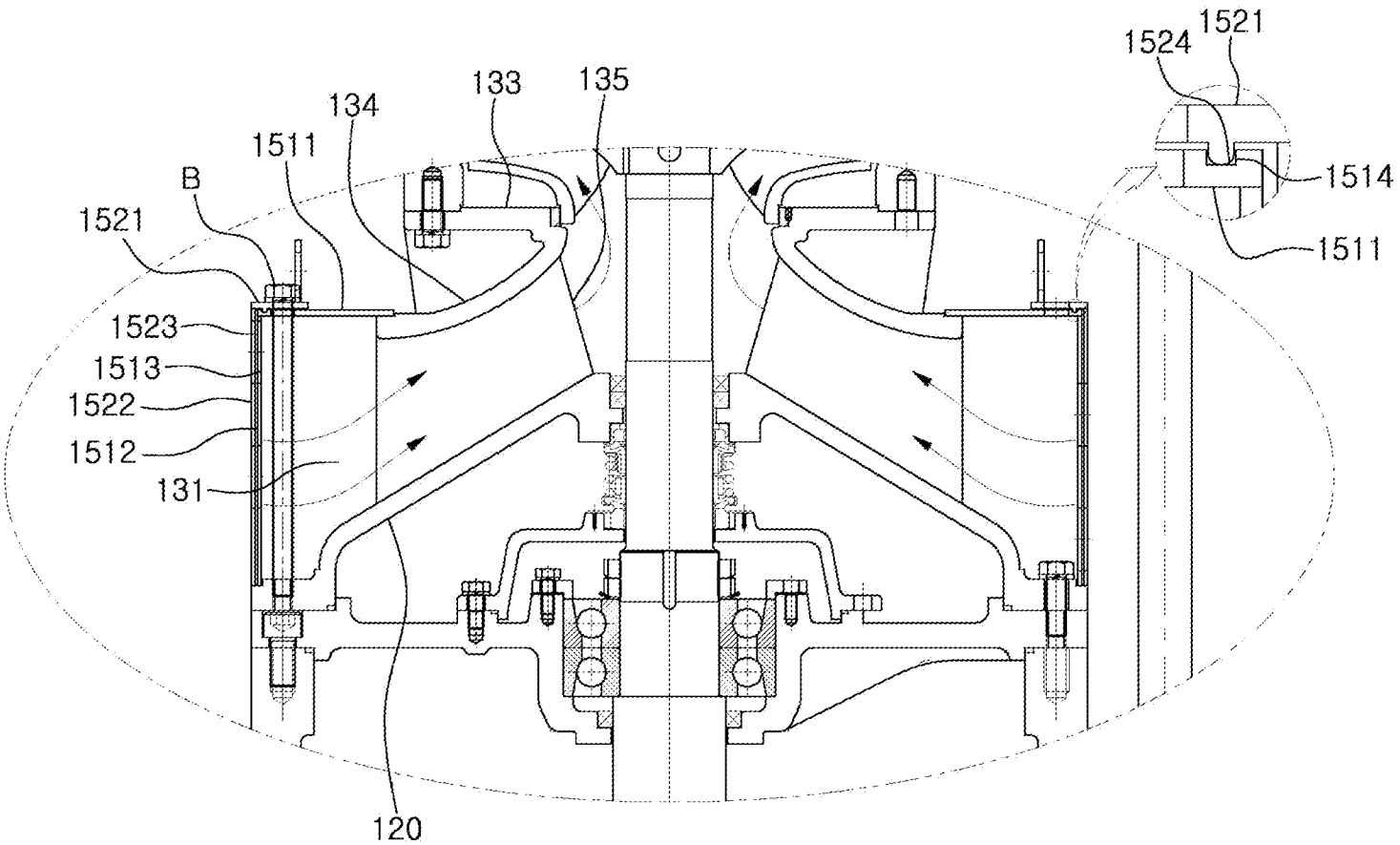
FIG. 3 is a detailed view of part 'A'.
Figure 4:
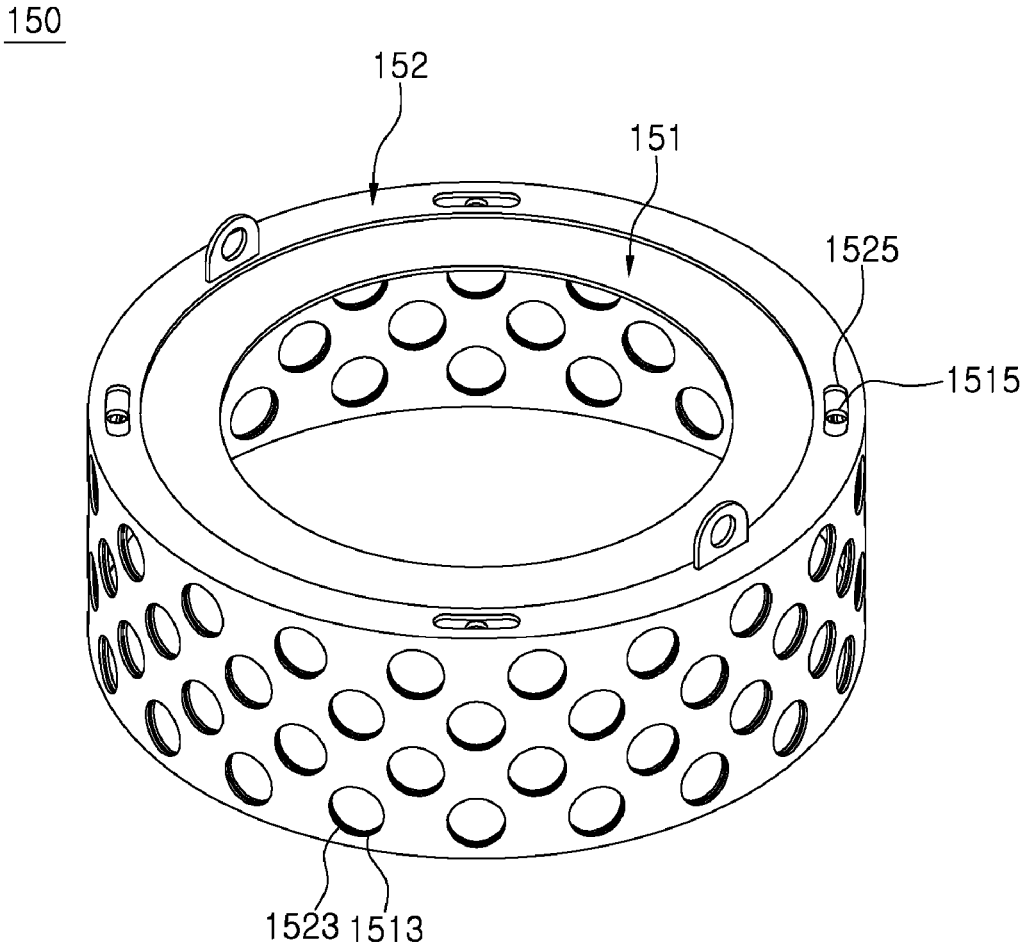
FIG. 4 is a perspective view of a strainer according to the present disclosure.
Figure 5:
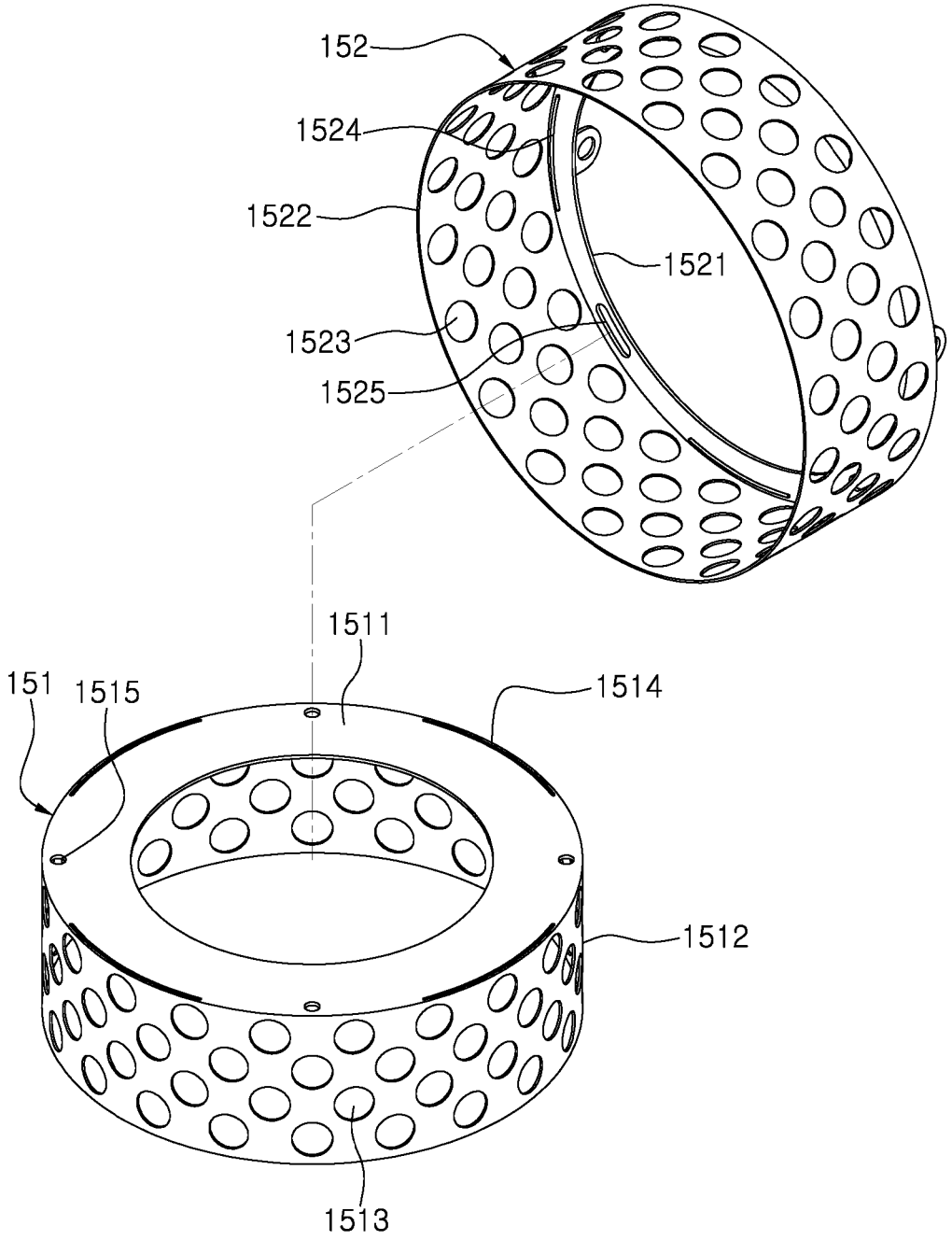
FIG. 5 is a perspective view illustrating a state in which the strainer according to the present disclosure is disassembled.
Figure 6:
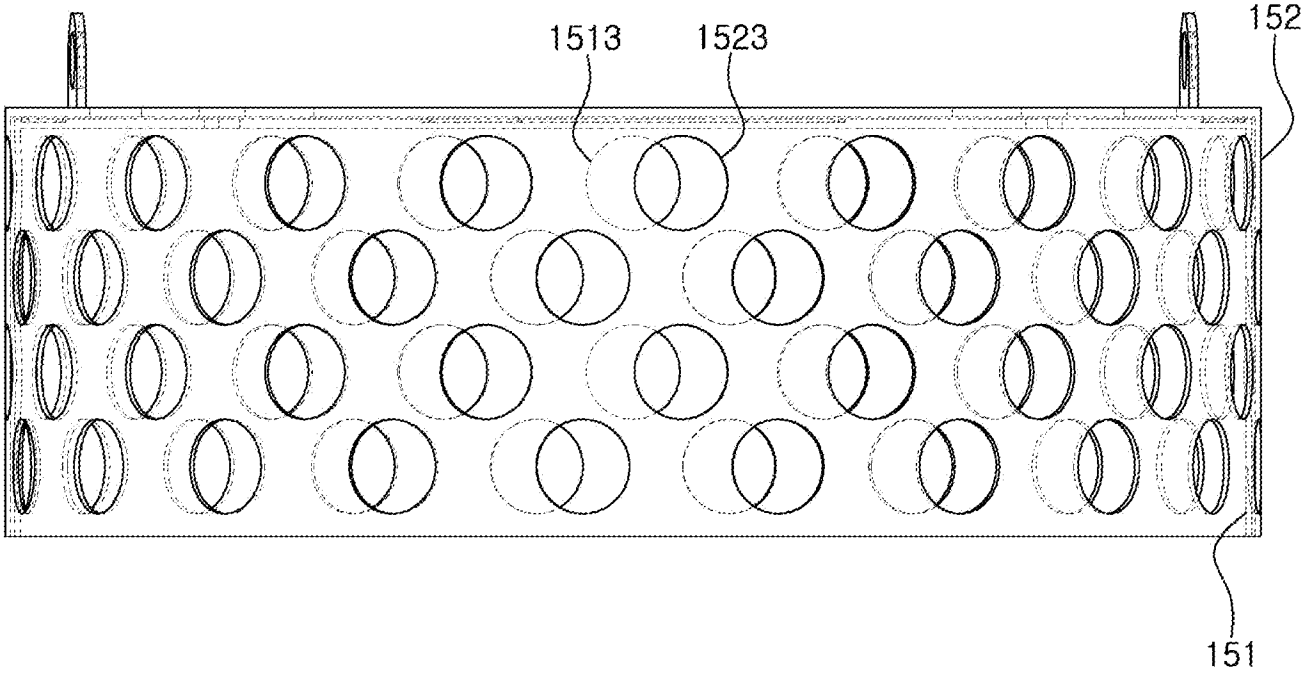
FIG. 6 is an exemplified view illustrating a state in which a passage area of filtering holes is adjusted by a rotation of an outer strainer according to the present disclosure.

FIG. 2 is a view illustrating an internal structure of a vertical multi-stage submersible pump according to an exemplary embodiment of the present disclosure, FIG. 3 is a detailed view of part 'A', FIG. 4 is a perspective view of a strainer according to the present disclosure, FIG. 5 is a perspective view illustrating a state in which the strainer according to the present disclosure is disassembled, and FIG. 6 is an exemplified view illustrating a state in which a passage area of filtering holes is adjusted by a rotation of an outer strainer according to the present disclosure.

The vertical multi-stage submersible pump according to the exemplary embodiment of the present disclosure includes a motor part 110, a water chamber casing 120, a suction casing 130, and a pump part 140. The motor part 110 is installed at a lowermost side, and the water chamber casing 120, the suction casing 130, and the pump part 140 are installed to be sequentially positioned above the motor part 110.

The motor part 110 includes a stator 112 and a rotor 113 installed in a motor casing 111. A rotary shaft 114, which is fixedly installed on the rotor 113 and configured to rotate together with the rotor 113, protrudes upward from the motor casing 111.

Meanwhile, the rotary shaft 114 penetrates the water chamber casing 120 and the suction casing 130 and extends to the inside of the pump part 140. The rotary shaft 114 is coupled to a plurality of impellers 142 in the pump part 140.

The water chamber casing 120 includes an oil seal 121 and a mechanical seal 122 installed above the motor casing 111 and configured to prevent a part of a pumping fluid from being introduced into the motor part 110 through a gap between the rotary shaft 114 and the casing.

Meanwhile, an upper end of the water chamber casing 120 according to the exemplary embodiment of the present disclosure has a conical structure. The upper end of the water chamber casing 120 defines a lower structure of a suction flow path W1.

The suction casing 130 is assembled to an upper portion of the water chamber casing 120 and defines the suction flow path W1 having the conical structure collectively with the water chamber casing 120. A suction port 131, through which the fluid in the water tub is introduced, is formed in a circumference of the suction casing 130. A discharge port 132, through which the introduced fluid is delivered to the pump part 140, is formed in a central portion of an upper surface of the suction casing 130.

The suction casing 130 has a suction guide portion 134 disposed below a fixing plate 133 having a central portion in which the discharge port 132 is formed. The suction guide portion 134 is provided in the form of a bell mouth widened downward. A plurality of guide vanes 135 is provided at a lower end of the suction guide portion 134, each has a vertical posture, and is distributed in a circumferential direction. The suction guide portion 134, together with a circumferential structure defined by the upper end of the water chamber casing 120, defines the suction flow path W1 having the conical structure.

The suction flow path W1 having the conical structure has a cross-section inclined upward toward the rotary shaft 114 and s the fluid introduced through the suction port 131 to naturally flow without rapidly changing the direction, thereby improving suctioning efficiency.

Meanwhile, when the suction casing 130 and the water chamber casing 120 are coupled, lower ends of the guide vanes 135 come into contact with an upper surface of the water chamber casing 120 and define partition walls having vertical postures in the suction flow path W1, thereby preventing the occurrence of vortices or turbulent flows of the fluid.

The plurality of impellers 142 is installed in a pump casing 141 of the pump part 140, and the pump casing 141 is fixed to the suction casing 130 by bolting in a state in which the pump casing 141 is seated on an upper portion of the suction casing 130. An inlet port 143 is provided in a central portion of a bottom surface of the pump casing 141 and connected to the discharge port 132 of the suction casing 130, and a discharge port 144 is provided in a central portion of an upper surface of the pump casing 141 and configured to discharge the fluid pressurized by the rotations of the impellers 142. The inside of the pump casing 141 has a space in which the plurality of impellers 142 is spaced apart from one another in the vertical direction and connected to the rotary shaft 114, and a space that defines a flow path along which the fluid, which is introduced through the inlet port 143 by the rotations of the impellers 142, sequentially passes through the plurality of impellers 142 and is discharged through the discharge port 144.

In the vertical multi-stage submersible pump configured as described above, the fluid in the water tub, in which the pump is installed, is introduced through the suction port 131 formed in the suction casing 130 when the rotary shaft 114 and the impellers 142 are rotated by the operation of the motor part 110, and the fluid passes through the plurality of impellers 142 while flowing upward. The fluid, which is pressurized while passing through the plurality of impellers 142, is discharged to the outside of the pump through the discharge port 144.

Meanwhile, the pump further includes a strainer 150 configured to prevent foreign substances, such as sediment in the water tub, from being introduced into the suction port 131 together with the fluid during an operating process of the pump, and cable fasteners 160 configured to support a cable C extending to the ground from the motor part 110 so that the cable C is spaced apart from the suction port 131. The strainer 150 according to the exemplary embodiment of the present disclosure has a dual structure including an inner strainer 151 and an outer strainer 152, and a passage area of the filtering holes may be adjusted depending on the circumstances by a rotation of the outer strainer 152.

More specifically, the inner strainer 151 includes a first upper plate 1511 provided in the form of a circular board, and a first side plate 1512 having a cylindrical structure extending along a circumference of the first upper plate 1511, protruding downward from the first upper plate 1511, and having a plurality of first filtering holes 1513 formed to be distributed. A plurality of guide grooves 1514 is recessed in an upper surface of the first upper plate 1511 by a predetermined depth and each has an arc shape while extending in the circumferential direction of the first upper plate 1511. The plurality of guide grooves 1514 is distributed in the circumferential direction.

A part of the first upper plate 1511 of the inner strainer 151 is seated on the fixing plate 133 of the suction casing 130, a lower end of the first side plate 1512 is seated on the water chamber casing 120 and fixed to the suction casing 130 and the water chamber casing 120 by bolts B that penetrate the inner and outer strainers 151 and 152 and are fastened to the water chamber casing 120.

The outer strainer 152 includes a second upper plate 1521 provided in the form of a circular board having a larger diameter than the first upper plate 1511, and a second side plate 1522 having a cylindrical structure extending along a circumference of the second upper plate 1521, protruding downward from the second upper plate 1521, and having a plurality of second filtering holes 1523 formed to be distributed. A plurality of guide protrusions 1524 is formed and distributed on a bottom surface of the second upper plate 1521 in the circumferential direction. The plurality of guide protrusions 1524 is inserted into the guide grooves 1514 of the first upper plate 1511 and moves along the guide grooves 1514.

Meanwhile, through-holes 1515 and 1525 are respectively formed in the first upper plate 1511 and the second upper plate 1521, and the bolts, which are fastened to fix the inner strainer 151 and the outer strainer 152 to the water chamber casing 120, penetrate the through-holes 1515 and 1525. The through-hole 1525 formed in the second upper plate 1521 has a rectangular structure extending by a predetermined length in the circumferential direction of the second upper plate 1521, such that the outer strainer 152 may be rotated and adjusted within a limited range regardless of the bolt B.

In the case of the strainer 150 of the present disclosure including the inner strainer 151 and the outer strainer 152, areas in which the first filtering holes 1513 and the second filtering holes 1523 overlap one another may be adjusted by the rotation of the outer strainer 152, such that the passage area of the filtering holes may be adjusted depending on the circumstances.

For example, the passage area of the filtering holes has a maximum value when the first filtering holes 1513 and the second filtering holes 1523 fully overlap one another. The passage area of the filtering holes decreases as the second filtering holes 1523 and the second filtering holes 1523 are disposed in a staggered manner.

The cable fasteners 160 each include a support bracket 161 installed outside the motor casing 111 and the pump casing 141 and provided in the form of a board, and a clamp 162 provided in the form of a stick bent in a U shape and fixed to the support bracket 161 while surrounding the cable C.

Meanwhile, the support bracket 161 is fixedly installed on the motor casing 111 and the pump casing 141 by bolting. Two opposite ends of the clamp 162 bent in a U shape penetrate the support bracket 161 and are fastened to nuts so as to be fixed to the support bracket 161.

The cable fastener 160 securely supports the cable C positioned in the water and prevents the cable C from swaying and being damaged by a water flow. The cable fastener 160 spaces the cable C from the suction port 131 to prevent the cable C from hindering the introduction of the fluid.

According to the vertical multi-stage submersible pump according to the present disclosure configured as described above, when the impellers 142 are rotated by the operation of the motor part 110, the fluid in the water tub, in which the pump is installed, is introduced into the pump casing 141 through the suction casing 130 by a suction force generated in the pump casing 141 by the rotations of the impellers 142. The fluid sequentially passes through the plurality of impellers 142 in the pump casing 141 and then is discharged through the discharge port 144 provided at the upper end of the pump casing 141.

According to the vertical multi-stage submersible pump according to the present disclosure, the pump part 140 is provided above the motor part 110, and the discharge port 144 is provided in the upper surface of the pump casing 141, such that a discharge flow path is straightened, which may improve discharge efficiency.

Meanwhile, the fluid passes through the strainer 150, which is installed in the suction port 131, during the process in which the fluid is introduced into the suction casing 130, which may reduce a degree to which sediment or the like on the bottom of the water tub is introduced into the suction port 131 together with the fluid. In particular, the suction port 131 of the vertical multi-stage submersible pump according to the present disclosure is positioned at a middle portion of the pump and thus positioned at a position spaced apart from the bottom of the water tub at a predetermined distance, which may more effectively prevent the introduction of foreign substances.

In addition, the strainer 150 for preventing the introduction of foreign substances has the dual structure in which the areas in which the first filtering holes 1513 and the second filtering holes 1523 overlap one another are adjusted by the rotation of the outer strainer 152, such that the passage area of the filtering holes may be freely set. The structure of the strainer 150 suitable for the pumping fluid may be implemented by simply manipulating and rotating the outer strainer 152 without replacing the strainer 150 even though the pumping fluid is changed.

The present disclosure is not limited to the specific exemplary embodiment described above, various modifications can be made by any person skilled in the art to which the present disclosure pertains without departing from the subject matter of the present disclosure as claimed in the claims, and the modifications are within the scope defined by the claims.

What is claimed is:

1. A vertical multi-stage submersible pump comprising:

a motor part (110) including a stator (112) and a rotor (113) installed in a motor casing (111), the motor part (110) having a rotary shaft (114) connected to the rotor (113), configured to rotate, and protruding upward from the motor casing (111);

a water chamber casing (120) assembled to an upper portion of the motor casing (111) and including an oil seal (121) and a mechanical seal (122) configured to define a sealing structure around the rotary shaft (114);

a suction casing (130) assembled to an upper portion of the water chamber casing (120) and having a suction port (131) formed in a circumference of the suction casing (130) so that a fluid is introduced into the suction port (131), the suction casing (130) having a discharge port (132) formed in a central portion of an upper surface of the suction casing (130); and a pump part (140) configured such that a plurality of impellers (142) is spaced apart from one another in a vertical direction in a pump casing (141) assembled to an upper portion of the suction casing (130), having an inlet port (143) formed in a central portion of a bottom surface of the pump casing (141) and connected to the discharge port (132) of the suction casing (130), and having a discharge port (144) formed in an upper surface of the pump casing (141), and the plurality of impellers (142) is connected to the rotary shaft (114) and pumps the fluid in a stepwise manner while rotating together with the rotary shaft (114), wherein an upper end of the water chamber casing (120) has a conical structure and defines a conical suction flow path (W1) having a cross-section inclined upward toward the rotary shaft (114) collectively with the suction casing (130), and wherein a plurality of guide vanes (135) is positioned in the suction flow path (W1) and provided in the suction casing (130) or the water chamber casing (120) to prevent the occurrence of vortices of the introduced fluid.

2. The vertical multi-stage submersible pump of claim 1, further comprising:

a strainer (150) installed in the suction casing (130) to prevent foreign substances from being introduced through the suction port (131), wherein the strainer (150) comprises:

an inner strainer (151) including a first upper plate (1511) provided in the form of a circular board, and a first side plate (1512) having a cylindrical structure extending along a circumference of the first upper plate (1511) and having a plurality of first filtering holes (1513) formed to be distributed, the first upper plate (1511) being fixedly installed on the suction casing (130); and an outer strainer (152) including a second upper plate (1521) provided in the form of a circular board having a larger diameter than the first upper plate (1511), and a second side plate (1522) having a cylindrical structure extending along a circumference of the second upper plate (1521) and having a plurality of second filtering holes (1523) formed to be distributed, the outer strainer (152) being configured to rotate about the inner strainer (151) in a state in which the outer strainer (152) is disposed outside the inner strainer (151) and coupled to the inner strainer (151) such that sizes of the filtering holes are changed by adjusting areas in which the first filtering holes (1513) and the second filtering holes (1523) overlap one another.

3. The vertical multi-stage submersible pump of claim 2, wherein a guide groove (1514) is recessed in an upper surface of the first upper plate (1511) by a predetermined depth from the upper surface of the first upper plate (1511) and extends in a circumferential direction of the first upper plate (1511), and a guide protrusion (1524) is formed on a bottom surface of the second upper plate (1521) and configured to move along the guide groove (1514) in a state in which the guide protrusion (1524) is introduced into the guide groove (1514).

4. The vertical multi-stage submersible pump of claim 1, wherein a cable (C) extends to the ground from the motor part (110) to transmit electricity and a signal for operating the motor part (110), and a plurality of cable fasteners (160) for fixing the cable (C) is installed on at least one of the motor casing (111) and the pump casing (141) so that the cable (C) is positioned at a position spaced apart from the suction port (131) of the suction casing (130).

* * * * *